US011619245B2

(12) United States Patent
Shinjo

(10) Patent No.: US 11,619,245 B2
(45) Date of Patent: Apr. 4, 2023

(54) FLUID CIRCUIT FOR AIR CYLINDER

(71) Applicant: SMC CORPORATION, Tokyo (JP)

(72) Inventor: Naoki Shinjo, Nagareyama (JP)

(73) Assignee: SMC CORPORATION, Tokyo (JP)

( * ) Notice: Subject to any disclaimer, the term of this patent is extended or adjusted under 35 U.S.C. 154(b) by 0 days.

(21) Appl. No.: 17/665,645

(22) Filed: Feb. 7, 2022

(65) Prior Publication Data

US 2022/0268298 A1 Aug. 25, 2022

(30) Foreign Application Priority Data

Feb. 19, 2021 (JP) ..... JP2021-024785

(51) Int. Cl.

| | |
|---|---|
| ***F15B 11/06*** | (2006.01) |
| ***F15B 11/042*** | (2006.01) |
| ***F15B 15/14*** | (2006.01) |
| ***F15B 13/04*** | (2006.01) |

(52) U.S. Cl.

CPC ..... *F15B 13/0401* (2013.01); *F15B 11/042* (2013.01); *F15B 11/06* (2013.01); *F15B 15/149* (2013.01); *F15B 2211/351* (2013.01); *F15B 2211/40507* (2013.01); *F15B 2211/40515* (2013.01); *F15B 2211/41536* (2013.01); *F15B 2211/455* (2013.01); *F15B 2211/8855* (2013.01)

(58) Field of Classification Search

CPC ..... F15B 11/04; F15B 11/0413; F15B 11/042; F15B 11/06; F15B 11/068; F15B 2211/351; F15B 2211/455; F15B 2211/8855

See application file for complete search history.

(56) References Cited

U.S. PATENT DOCUMENTS

| | | | | |
|---|---|---|---|---|
| 6,129,001 | A * | 10/2000 | Harju | F15B 11/064 91/399 |
| 10,030,677 | B2 * | 7/2018 | Shishido | F15B 11/0413 |
| 10,871,175 | B2 * | 12/2020 | Yamada | F15B 11/042 |
| 10,927,857 | B2 * | 2/2021 | Takakuwa | F15B 21/14 |
| 11,118,606 | B2 * | 9/2021 | Harimoto | F15B 11/044 |
| 2019/0136876 | A1 * | 5/2019 | Fallahi | F15B 11/0426 |

(Continued)

FOREIGN PATENT DOCUMENTS

| | | |
|---|---|---|
| DE | 42 01 464 A1 | 7/1993 |
| DE | 42 29 054 A1 | 3/1994 |
| EP | 0 341 530 A1 | 11/1989 |

(Continued)

OTHER PUBLICATIONS

Extended European Search Report dated Jul. 1, 2022 in European Patent Application No. 22156257.2, 7 pages.

*Primary Examiner* — Michael Leslie

(74) *Attorney, Agent, or Firm* — Oblon, McClelland, Maier & Neustadt, L.L.P.

(57) ABSTRACT

In a fluid circuit for an air cylinder connected to a switching valve provided with exhaust ports, a head-side pressure chamber is connected to the switching valve by a first pipe, and a rod-side pressure chamber is connected to the switching valve by a second pipe. A first restrictor is disposed at a connection point between the first pipe and the switching valve or in the vicinity of a first output port of the switching valve, and a second restrictor is disposed at a connection point between the second pipe and the switching valve or in the vicinity of a second output port of the switching valve.

4 Claims, 7 Drawing Sheets

(56) References Cited

U.S. PATENT DOCUMENTS

| | | | | |
|---|---|---|---|---|
| 2020/0355203 | A1 | 11/2020 | Takada et al. | |
| 2021/0404486 | A1 * | 12/2021 | Takakuwa | F15B 11/06 |

FOREIGN PATENT DOCUMENTS

| | | | | | |
|---|---|---|---|---|---|
| EP | 0 841 453 | A2 | | 5/1998 | |
| JP | 58-1211 | A | | 1/1983 | |
| JP | 2019-044952 | A | | 3/2019 | |
| KR | 20220001167 | U | * | 5/2022 | F15B 11/06 |

* cited by examiner

FIG. 4

| | Maximum temperature[℃] | | | | | |
|---|---|---|---|---|---|---|
| | Cylinder tube | Head cover | Rod cover | Switching valve | First restrictor | Second restrictor |
| Comparative Example 1 | 100 | 111 | 63 | 17 | 111 | 63 |
| Comparative Example 2 | 64 | 50 | 46 | 24 | 52 | 29 |
| Present invention | 56 | 39 | 39 | 25 | 25 | 26 |

80

FLUID CIRCUIT FOR AIR CYLINDER

CROSS-REFERENCE TO RELATED APPLICATIONS

This application is based upon and claims the benefit of priority from Japanese Patent Application No. 2021-024785 filed on Feb. 19, 2021, the contents of which are incorporated herein by reference.

BACKGROUND OF THE INVENTION

Field of the Invention

The present invention relates to a fluid circuit for an air cylinder including a restrictor.

Description of the Related Art

Conventionally, there has been known a technique in which a fixed restrictor (fixed orifice) is provided at a supply port and a discharge port of an air cylinder in order to limit the speed of the air cylinder. In order to enable the speed of the air cylinder to be adjusted to an optimum value, a technique is known in which a variable restrictor (variable orifice) is provided at the supply port and the discharge port of the air cylinder.

For example, JP 2019-044952 A discloses an air cylinder equipped with a first speed controller and a second speed controller. The first speed controller is attached to an opening part of a cylinder port portion for supplying and discharging compressed air to the first cylinder chamber of the air cylinder. The second speed controller is attached to an opening part of a cylinder port portion for supplying and discharging compressed air to the second cylinder chamber of the air cylinder.

By the way, when an air cylinder provided with a restrictor at a supply port and a discharge port is operated at high speed and high frequency, a large amount of thermal energy is accumulated in a cylinder chamber, and a temperature rise in each part of the air cylinder becomes large. If the air cylinder does not have sufficient heat resistance, or if the operating speed and operating frequency of the air cylinder become higher than expected, the durability of the air cylinder may be impaired. That is, the temperature rise of the air cylinder may adversely affect rubber members such as a packing and a damper provided in the air cylinder.

SUMMARY OF THE INVENTION

The present invention has the object of solving the aforementioned problems.

A fluid circuit for an air cylinder according to the present invention is connected to a switching valve provided with an exhaust port. The air cylinder includes a head-side pressure chamber and a rod-side pressure chamber defined by a piston. The head-side pressure chamber is connected to a first output port of the switching valve by a first pipe, and the rod-side pressure chamber is connected to a second output port of the switching valve by a second pipe. Air supply and discharge to and from the head side pressure chamber and the rod side pressure chamber are switched by the switching valve. A first restrictor is disposed at a connection point between the first pipe and the switching valve or in the vicinity of the first output port of the switching valve, and a second restrictor is disposed at a connection point between the second pipe and the switching valve or in the vicinity of the second output port of the switching valve.

According to the fluid circuit of the air cylinder, the volume of the first pipe and a volume of the second pipe are included in a volume of air in which heat generated by the restrictors is accumulated. Therefore, not only the temperature rise of air is suppressed, but also the temperature rise of the air cylinder is suppressed because the switching valve is cooled as air is discharged from an exhaust port.

In the fluid circuit for an air cylinder according to the present invention, a first restrictor is disposed at a connection point between a first pipe and a switching valve or in the vicinity of a first output port of the switching valve, and a second restrictor is disposed at a connection point between a second pipe and the switching valve or in the vicinity of a second output port of the switching valve. Therefore, the heat capacity of air can be increased, and further the cooling effect can be obtained, whereby the temperature rise of the air cylinder can be suppressed.

The above and other objects, features, and advantages of the present invention will become more apparent from the following description when taken in conjunction with the accompanying drawings, in which a preferred embodiment of the present invention is shown by way of illustrative example.

BRIEF DESCRIPTION OF THE DRAWINGS

FIG. 4 is a table summarizing measurement data relating to the present invention and the Comparative Examples.

DESCRIPTION OF THE INVENTION

First, the basic concept of the present invention will be described with reference to Comparative Examples 1 and 2. In the present invention, a restrictor (orifice) is disposed at a connection point between a pipe for supplying and discharging air to and from an air cylinder and a switching valve or in the vicinity of an output port of the switching valve. The present invention will be described with reference to the configurations common to the present invention and Comparative Examples 1 and 2.

Figure 1:
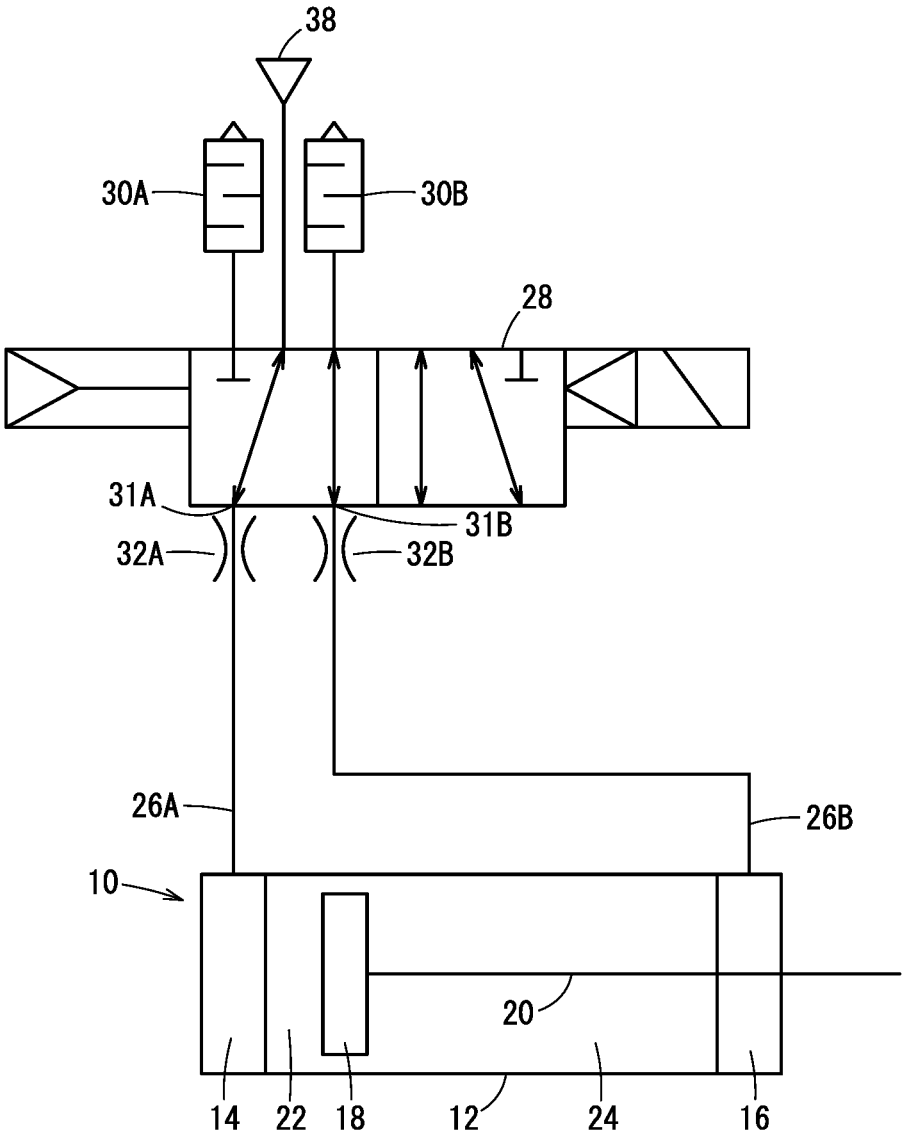
FIG. 1 is a view for explaining the basic concept of the present invention.

As shown in FIG. 1, the air cylinder 10 includes a cylinder tube 12, a head cover 14, a rod cover 16, and a piston 18. A head-side pressure chamber 22 located between the piston 18 and the head cover 14 is connected to a first output port 31A of a switching valve 28 by a first pipe 26A. A rod-side pressure chamber 24 located between the piston 18 and the rod cover 16 is connected to a second output port 31B of the switching valve 28 by a second pipe 26B. The switching valve 28 is provided with a first exhaust port 30A and a second exhaust port 30B, which are open to the atmosphere.

The switching valve 28 is configured to be switchable between a first position and a second position. At the first position, air from a fluid supply source 38 is supplied to the head-side pressure chamber 22 through the first pipe 26A, and air in the rod-side pressure chamber 24 is released to the atmosphere through the second pipe 26B. At the second position, air from the fluid supply source 38 is supplied to the rod-side pressure chamber 24 through the second pipe 26B, and air in the head-side pressure chamber 22 is released to the atmosphere through the first pipe 26A. When the switching valve 28 is switched to the first position, the piston rod 20 is extended. When the switching valve 28 is switched to the second position, the piston rod 20 is retracted.

The common parts of the present invention to Comparative Examples 1 and 2 are as described above. In the present invention, a first restrictor 32A is disposed at a connection point between the first pipe 26A and the switching valve 28 or in the vicinity of a first output port 31A of the switching valve 28. Further, a second restrictor 32B is disposed at a connection point between the second pipe 26B and the switching valve 28 or in the vicinity of a second output port 31B of the switching valve 28.

Figure 2:
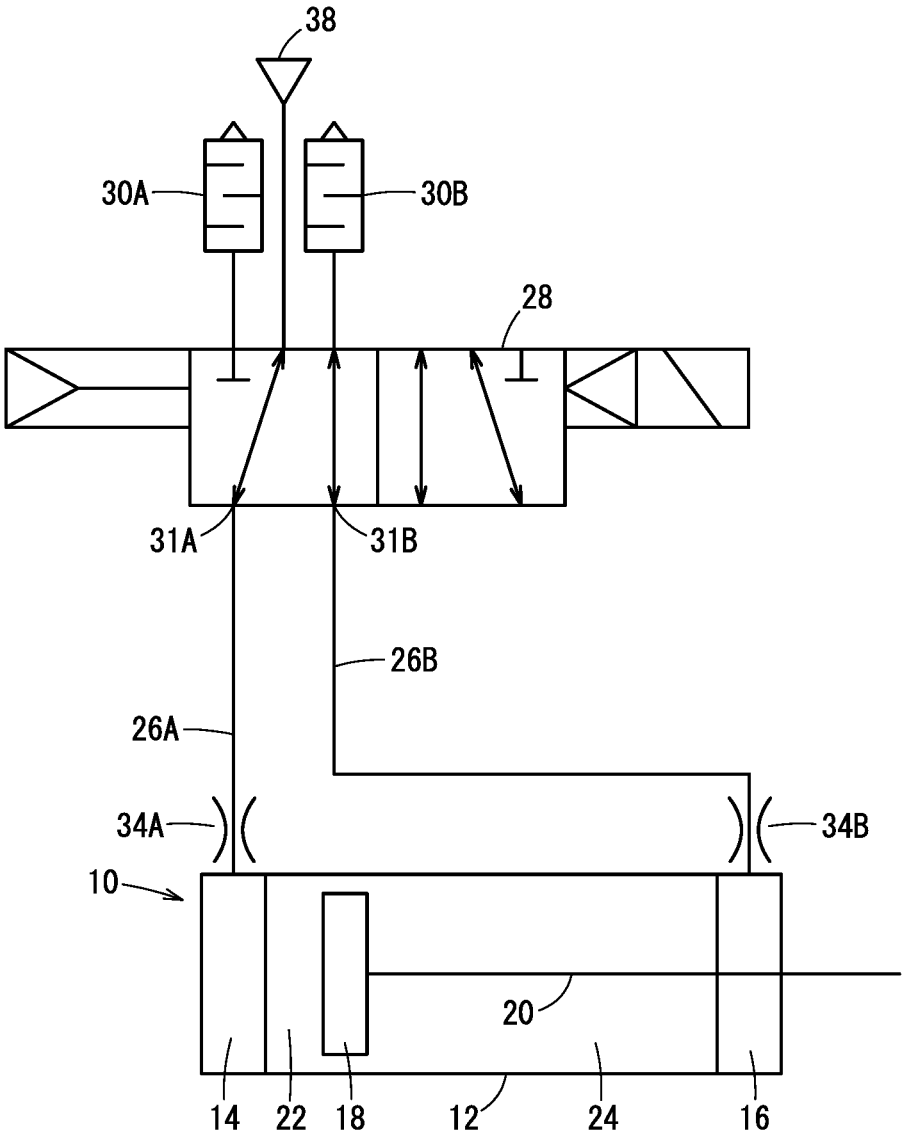
FIG. 2 is a conceptual diagram of Comparative Example 1.

On the other hand, in the Comparative Example 1, as shown in FIG. 2, a first restrictor 34A is disposed at a position (head-side port) where the head-side pressure chamber 22 is connected to the first pipe 26A. Further, a second restrictor 34B is disposed at a position (rod-side port) where the rod-side pressure chamber 24 is connected to the second pipe 26B.

Figure 3:
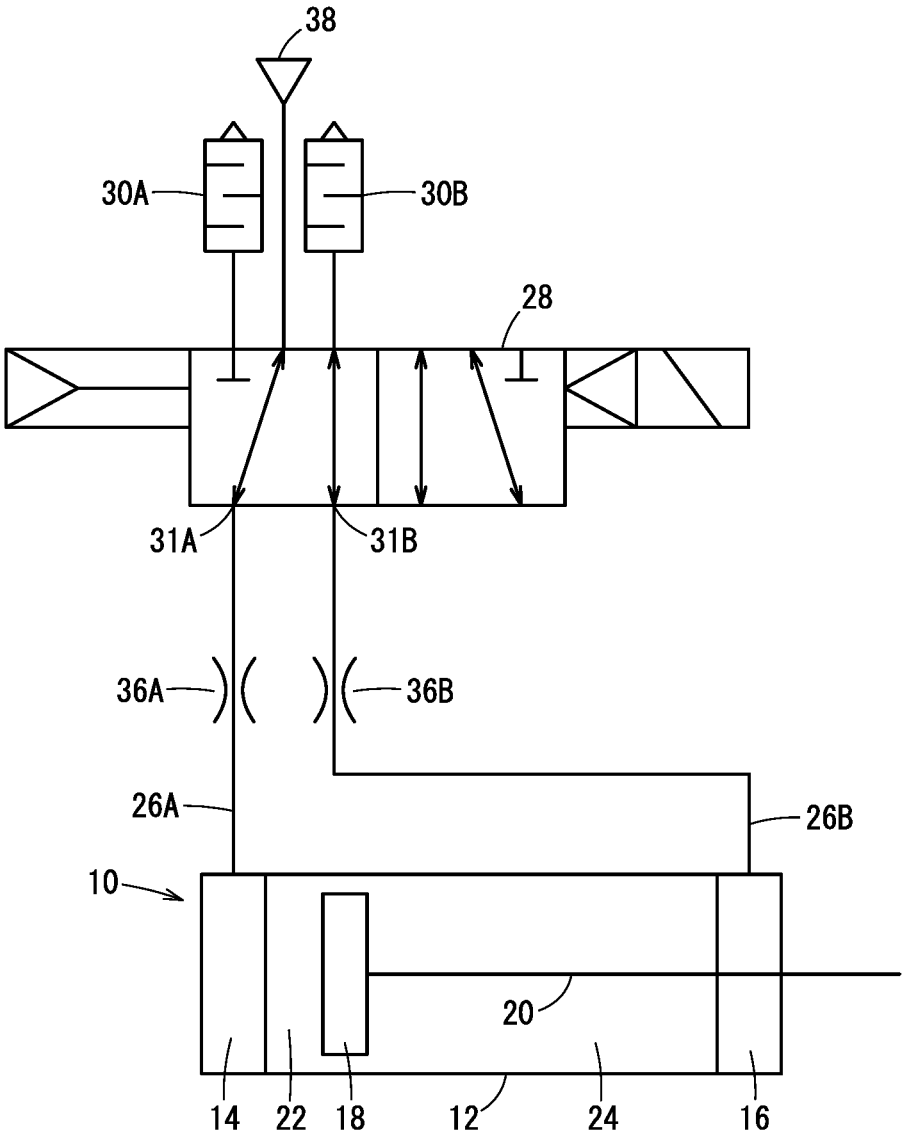
FIG. 3 is a conceptual diagram of Comparative Example 2.

In the second Comparative Example, as shown in FIG. 3, a first restrictor 36A is disposed at a middle portion of the first pipe 26A, and a second restrictor 36B is disposed at a middle portion of the second pipe 26B. In Comparative Example 2, a portion of the first pipe 26A from the first restrictor 36A to the air cylinder 10 is referred to as a "downstream portion of the first pipe 26A". A portion of the second pipe 26B from the second restrictor 36B to the air cylinder 10 is referred to as a "downstream portion of the second pipe 26B".

Next, the generation and movement of heat and the accompanying temperature rise of the air cylinder 10 in Comparative Example 1 will be described.

In the process of extending the piston rod 20, air is filled into the head-side pressure chamber 22 through the first restrictor 34A. When the air passes through the first restrictor 34A, part of the energy contained in the air is converted into thermal energy. This heat enters the head-side pressure chamber 22 together with the air while increasing the temperature of the air. This heat is transferred to the components of the air cylinder 10 such as the head cover 14 using air as a medium, and increases the temperature of the components. Part of the heat is transferred from the first restrictor 34A to the components of the air cylinder 10 by thermal conduction. Although heat is also generated when the air in the rod-side pressure chamber 24 passes through the second restrictor 34B in the process of extending the piston rod 20, this heat has little effect on the air cylinder 10.

In the process of retracting the piston rod 20, air is filled into the rod-side pressure chamber 24 through the second restrictor 34B. When the air passes through the second restrictor 34B, part of the energy contained in the air is converted into thermal energy. This heat enters the rod-side pressure chamber 24 together with the air while increasing the temperature of the air. This heat is transferred to the components of the air cylinder 10 such as the rod cover 16 using air as a medium, thereby increasing the temperature of the components. Part of the heat is transferred from the second restrictor 34B to the components of the air cylinder 10 by thermal conduction. Although heat is also generated when the air in the head-side pressure chamber 22 passes through the first restrictor 34A in the process of retracting the piston rod 20, this heat has little effect on the air cylinder 10.

Part of the heat that has entered the head-side pressure chamber 22 in the process of extending the piston rod 20 and has been stored therein is discharged together with air from the first restrictor 34A toward the first pipe 26A in the subsequent process of retracting the piston rod 20. In addition, part of the heat that has entered the rod-side pressure chamber 24 in the process of retracting the piston rod 20 and has been stored therein is discharged together with air from the second restrictor 34B toward the second pipe 26B in the subsequent process of extending the piston rod 20.

In this manner, heat generated through the processes of extending and retracting the piston rod 20 is accumulated in the air cylinder 10 to a certain degree. When the reciprocating motion of the piston 18 is repeated, the temperature of the air cylinder 10 rises until the amount of heat radiation of the air cylinder 10, mainly natural heat radiation, is in balance with the amount of heat received by the air cylinder 10. In Comparative Example 1, the air cylinder 10 can be very hot.

Next, the generation and movement of heat and the accompanying temperature rise of the air cylinder 10 in Comparative Example 2 will be described.

In the process of extending the piston rod 20, air is filled into the downstream portion of the first pipe 26A and the head-side pressure chamber 22 through the first restrictor 36A. When the air passes through the first restrictor 36A, part of the energy contained in the air is converted into thermal energy. This heat is carried together with the air to the downstream portion of the first pipe 26A and the head-side pressure chamber 22 while increasing the temperature of the air. This heat is transferred to the components of the air cylinder 10 such as the head cover 14 using air as a medium, and increases the temperature of the components. Part of the heat is transferred from the first restrictor 36A to the first pipe 26A by thermal conduction, and further transferred from the first pipe 26A to the components of the air cylinder 10.

In the process of retracting the piston rod 20, air is filled into the downstream portion of the second pipe 26B and the rod-side pressure chamber 24 through the second restrictor 36B. When air passes through the second restrictor 36B, part of the energy contained in the air is converted into thermal energy. This heat is carried together with the air to the downstream portion of the second pipe 26B and the rod-side pressure chamber 24 while increasing the temperature of the air. This heat is transferred to the components of the air cylinder 10 such as the rod cover 16 using air as a medium, thereby increasing the temperature of the components. Part of the heat is transferred from the second restrictor 36B to the second pipe 26B by thermal conduction, and further transferred from the second pipe 26B to the components of the air cylinder 10.

In this manner, the heat generated through the processes of extending and retracting the piston rod 20 is accumulated not only in the air cylinder 10 but also in the downstream portion of the first pipe 26A and the downstream portion of the second pipe 26B.

When the reciprocating motion of the piston 18 is repeated, the temperature of the air cylinder 10 rises until the amount of heat radiation of the air cylinder 10, mainly natural heat radiation, is in balance with the amount of heat received by the air cylinder 10. In this case, the volume of air receiving the generated heat is obtained by adding the volume of the downstream portion of the first pipe 26A and the volume of the downstream portion of the second pipe 26B, in addition to the volume of the head-side pressure chamber 22 and the volume of the rod-side pressure chamber 24. Therefore, the heat capacity of air is larger than that of Comparative Example 1, the temperature of air does not become as high as that of Comparative Example 1, and the temperature of the air cylinder 10 also does not become as high as that of Comparative Example 1.

Next, the generation and movement of heat, heat radiation (cooling), and the accompanying temperature rise of the air cylinder 10 in the present invention will be described.

In the process of extending the piston rod 20, the entire first pipe 26A and the head-side pressure chamber 22 are filled with air through the first restrictor 32A. When air passes through the first restrictor 32A, part of the energy contained in the air is converted into thermal energy. This heat is carried together with the air to the first pipe 26A and the head-side pressure chamber 22 while increasing the temperature of the air. This heat is transferred to the components of the air cylinder 10 such as the head cover 14 using air as a medium, and increases the temperature of the components. Part of the heat is transferred from the first restrictor 32A to the first pipe 26A by thermal conduction, and further transferred from the first pipe 26A to the components of the air cylinder 10.

In the process of extending the piston rod 20, the air filled in the second pipe 26B and the rod-side pressure chamber 24 passes through the second restrictor 32B and is discharged into the atmosphere through the second exhaust port 30B attached to the switching valve 28. When air is discharged from the second exhaust port 30B, the air rapidly expands in an adiabatic state, and the temperature of the air decreases. Therefore, the switching valve 28 is cooled, and the first restrictor 32A and the second restrictor 32B are also cooled. Then, the effect of cooling the first pipe 26A, the second pipe 26B, and the air inside these pipes can be obtained. In the process of extending the piston rod 20, heat is also generated when the air filled in the second pipe 26B and the rod-side pressure chamber 24 passes through the second restrictor 32B, but this heat does not affect the air cylinder 10.

In the process of retracting the piston rod 20, air is filled through the second restrictor 32B into the entire second pipe 26B and the rod-side pressure chamber 24. When air passes through the second restrictor 32B, part of the energy contained in the air is converted into thermal energy. This heat is carried together with the air to the second pipe 26B and the rod-side pressure chamber 24 while increasing the temperature of the air. This heat is transferred to the components of the air cylinder 10 such as the rod cover 16 using air as a medium, thereby increasing the temperature of the components. Part of the heat is transferred from the second restrictor 32B to the second pipe 26B by thermal conduction, and is further transferred from the second pipe 26B to components of the air cylinder 10.

In the process of retracting the piston rod 20, the air filled in the first pipe 26A and the head side pressure chamber 22 passes through the first restrictor 32A and is discharged into the atmosphere through the first exhaust port 30A attached to the switching valve 28. When air is discharged from the first exhaust port 30A, the air rapidly expands in an adiabatic state, and the temperature of the air decreases. Therefore, the switching valve 28 is cooled, and the first restrictor 32A and the second restrictor 32B are also cooled. Then, the effect of cooling the first pipe 26A, the second pipe 26B, and the air inside these pipes can be obtained. In the process of retracting the piston rod 20, heat is also generated when the air filled in the first pipe 26A and the head-side pressure chamber 22 passes through the first restrictor 32A, but this heat does not affect the air cylinder 10.

In this manner, the heat generated by the processes of extending and retracting the piston rod 20 is accumulated not only in the air cylinder 10 but also in the entire first pipe 26A and the entire second pipe 26B. In addition, since the switching valve 28 is cooled through the processes of extending and retracting the piston rod 20, the effects of cooling the first pipe 26A, the second pipe 26B, and the air inside the first pipe 26A and the second pipe 26B are obtained.

As the reciprocating motion of the piston 18 is repeated, the temperature of the air cylinder 10 rises until the amount of heat radiated from the air cylinder 10 is in balance with the amount of heat received by the air cylinder 10. In the case of the present invention, the volume of the air for receiving the generated heat includes not only the volume of the head-side pressure chamber 22 and the volume of the rod-side pressure chamber 24, but also the total volume of the first pipe 26A and the total volume of the second pipe 26B, so that the heat capacity of air is larger than that of the Comparative Example 2. Further, since the first restrictor 32A and the second restrictor 32B are directly connected to the switching valve 28, the effect of cooling the first pipe 26A, the second pipe 26B, and the air inside the first pipe 26A and the second pipe 26B can be obtained. Therefore, it is difficult for the air to reach a high temperature, and the temperature rise of the air cylinder 10 can be sufficiently suppressed.

With respect to the fluid circuits of the air cylinders 10 of the present invention, Comparative Example 1 and Comparative Example 2, experiments were carried out to determine the temperature of each portion when the piston 18 is reciprocated (vibrated) at a predetermined cycle. "Each portion" includes the cylinder tube 12, the head cover 14, the rod cover 16, the switching valve 28, the first restrictors 32A, 34A, 36A, and the second restrictors 32B, 34B, 36B.

With respect to the air cylinder 10 used, the inner diameter of the cylinder tube 12 is 10 mm and the stroke of the piston 18 is 45 mm. The first pipe 26A used has an inner diameter of 4 mm and a length of 500 mm. Similarly, the second pipe 26B used has the inner diameter of 4 mm and the length of 500 mm. The orifice diameters of the first restrictors 32A, 34A and 36A are set to 1.1 mm, and the orifice diameters of the second restrictors 32B, 34B and 36B are set to 1.8 mm. With respect to the takt of the switching valve 28, the time from switching to the first position to switching to the second position and the time from switching to the second position to switching to the first position are both set to 35 ms.

In the case of the present invention, the distance from the air cylinder 10 to the first restrictor 32A is 500 mm, which is the same as the length of the first pipe 26A. The distance from the air cylinder 10 to the second restrictor 32B is 500 mm, which is the same as the length of the second pipe 26B. In the case of Comparative Example 1, the distance from the air cylinder 10 to the first restrictor 34A is 0, and the distance from the air cylinder 10 to the second restrictor 34B is 0. In the Comparative Example 2, the first restrictor 36A is disposed just at the center of the first pipe 26A, and the second restrictor 36B is disposed just at the center of the second pipe 26B. Therefore, the distance from the air cylinder 10 to the first restrictor 36A is 250 mm, and the distance from the air cylinder 10 to the second restrictor 36B is 250 mm.

When the air cylinder 10 was operated for 5 minutes at a room temperature of 25° C., the temperature (maximum temperature) of each portion was measured. A table summarizing the results of the measurement is shown in FIG. 4.

In Comparative Example 1, the cylinder tube 12 rose to 100° C., the head cover 14 rose to 111° C., and the rod cover 16 rose to 63° C. In Comparative Example 2, the cylinder tube 12 rose to 64° C., the head cover 14 rose to 50° C., and the rod cover 16 rose to 46° C.

On the other hand, in the present invention, the temperature of the cylinder tube 12 rose only to 56° C., and the temperatures of the head cover 14 and the rod cover 16 rose only to 39° C. In the present invention, it can be seen that the temperature rise of the components of the air cylinder 10 is sufficiently suppressed.

In Comparative Example 1, the temperature of the switching valve 28 is 17° C., which is lower than the room temperature, and it can be seen that the switching valve 28 is considerably cooled. Further, in Comparative Example 1, the temperature of the head cover 14 greatly exceeds the temperature of the rod cover 16. This indicates that the influence of heat generated in the first restrictor 34A having an orifice diameter smaller than the second restrictor 34B is large.

First Embodiment

Figure 5:
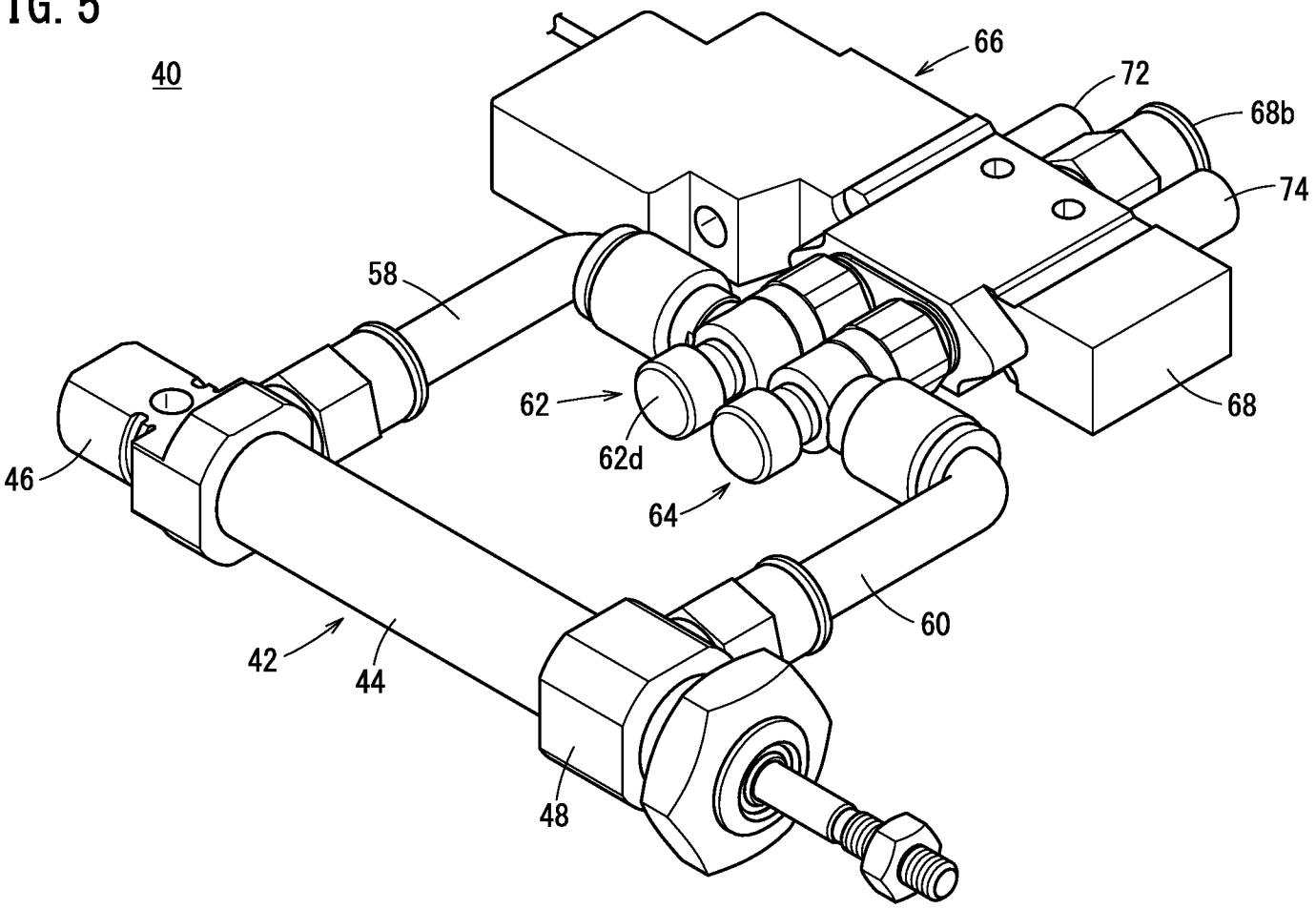
FIG. 5 is an external view of a fluid circuit of an air cylinder according to a first embodiment of the present invention.
Figure 6:
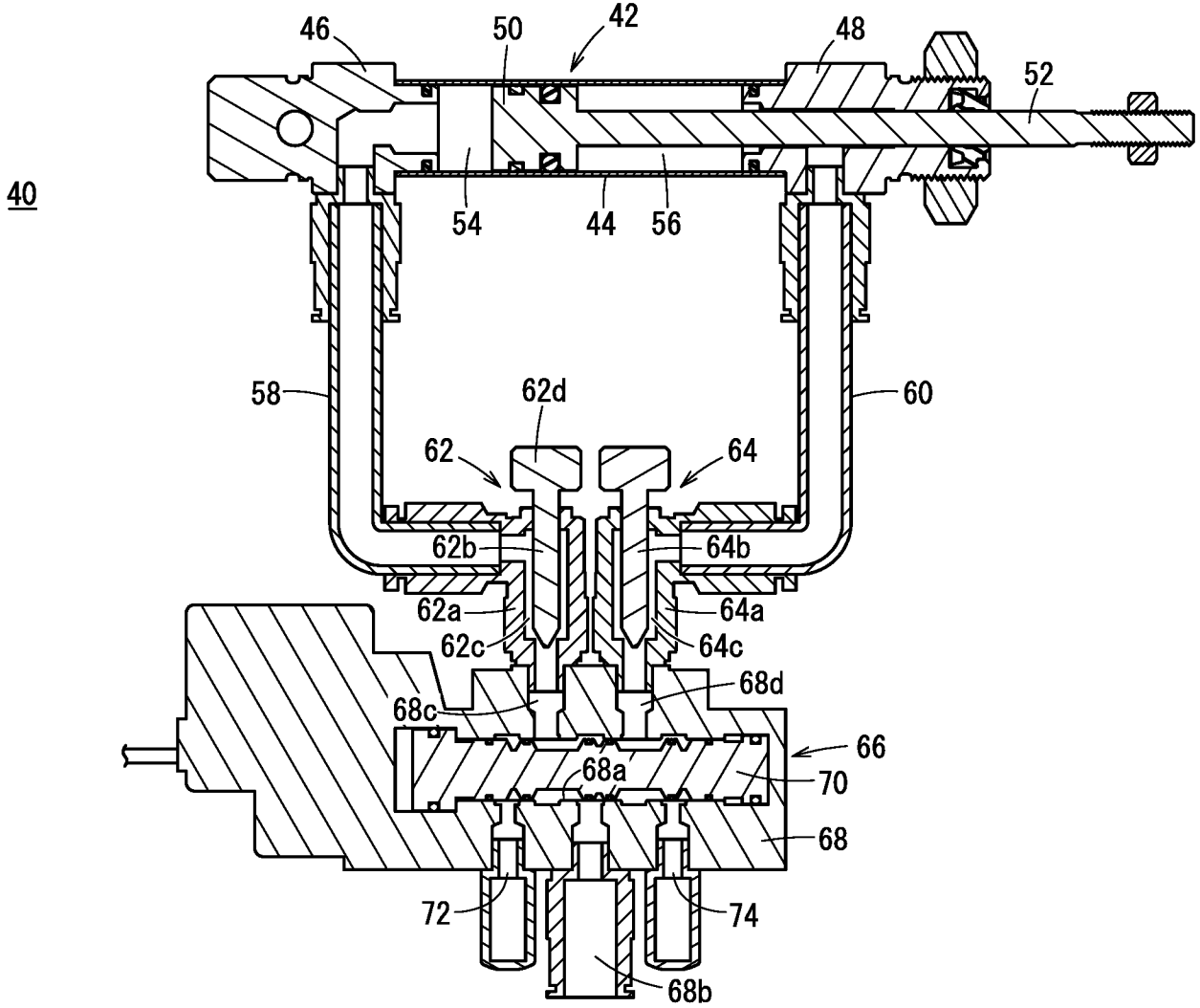
FIG. 6 is a sectional view of the fluid circuit of the air cylinder shown in FIG. 5.

A fluid circuit 40 of an air cylinder according to a first embodiment of the present invention will be described with reference to FIGS. 5 and 6. The fluid circuit 40 of the air cylinder includes an air cylinder 42, a first pipe 58, a second pipe 60, a first speed controller 62 (first restrictor), a second speed controller 64 (second restrictor), and a switching valve 66.

The switching valve 66 has a body 68 having a valve hole 68*a* therein and a spool valve body 70 slidably disposed in the valve hole 68*a*. The body 68 is provided with a first exhaust port 72 with a silencer and a second exhaust port 74 with a silencer. The body 68 includes a supply port 68*b* connected to a fluid supply source (not shown), a first output port 68*c* connected to the first speed controller 62, and a second output port 68*d* connected to the second speed controller 64.

The first speed controller 62, which is a variable (adjustable) restrictor, is constituted by a valve body 62*a* having an air passage 62*c* therein and a needle valve body 62*b* inserted into the air passage 62*c*. An end portion of the needle valve body 62*b* extending outward from the valve body 62*a* has a knob 62*d*. By rotating the knob 62*d*, the area of the air passage 62*c* can be changed. The valve body 62*a* is formed in an L shape. One end of the valve body 62*a* is connected to the first output port 68*c* of the switching valve 66, and the other end of the valve body 62*a* is connected to the first pipe 58.

Similar to the first speed controller 62, the second speed controller 64, which is a variable restrictor, is also constituted by a valve body 64*a* and a needle valve body 64*b*. One end of the valve body 64*a* is connected to the second output port 68*d* of the switching valve 66, and the other end of the valve body 64*a* is connected to the second pipe 60.

The air cylinder 42 includes a cylinder tube 44, a head cover 46, a rod cover 48, a piston 50, and a piston rod 52. The head-side pressure chamber 54 located between the piston 50 and the head cover 46 is connected to the first pipe 58. The rod-side pressure chamber 56 located between the piston 50 and the rod cover 48 is connected to the second pipe 60.

The switching valve 66 is configured to be switchable between a first position for extending the piston rod 52 and a second position for retracting the piston rod 52 according to the sliding position of the spool valve body 70. The switching valve 66 shown in FIG. 6 is in a state where the switching valve 66 has been switched to the first position.

When the switching valve 66 is in the first position, the air passage 62*c* of the first speed controller 62 communicates with the supply port 68*b*, and the air passage 64*c* of the second speed controller 64 communicates with the second exhaust port 74. Air from the fluid supply source is supplied to the first pipe 58 and the head-side pressure chamber 54 through the first speed controller 62. Further, the air in the second pipe 60 and the air in the rod-side pressure chamber 56 are discharged into the atmosphere from the second exhaust port 74 through the second speed controller 64.

When the switching valve 66 is in the second position, the air passage 64*c* of the second speed controller 64 communicates with the supply port 68*b*, and the air passage 62*c* of the first speed controller 62 communicates with the first exhaust port 72. Air from the fluid supply source is supplied to the second pipe 60 and the rod-side pressure chamber 56 through the second speed controller 64. Further, the air in the first pipe 58 and the air in the head-side pressure chamber 54 are discharged into the atmosphere through the first speed controller 62 through the first exhaust port 72.

Heat generated when air passes through the first speed controller 62 in the process of extending the piston rod 52 is carried together with air to the first pipe 58 and the head-side pressure chamber 54. Heat generated when air passes through the second speed controller 64 in the process of retracting the piston rod 52 is carried together with air to the second pipe 60 and the rod-side pressure chamber 56. That is, the volume of air for receiving the generated heat includes not only the volume of the head-side pressure chamber 54 and the volume of the rod-side pressure chamber 56, but also the total volume of the first pipe 58 and the total volume of the second pipe 60, and thus the heat capacity of air is large. Therefore, it is difficult for the air to reach a high temperature, and the temperature rise of the air cylinder 42 is suppressed.

When air is discharged from the second exhaust port 74 in the process of extending the piston rod 52, the temperature of the air decreases because of adiabatic expansion. When air is discharged from the first exhaust port 72 in the process of retracting the piston rod 52, the temperature of the air decreases because of adiabatic expansion. As a result, the switching valve 66 is cooled, and the first speed controller 62 and the second speed controller 64 are also cooled. The effect of cooling the first pipe 58, the second pipe 60, and the air inside the first pipe 58 and the second pipe 60 can be obtained. Therefore, the temperature rise of the air cylinder 42 is suppressed.

According to the present embodiment, the volume of air in which heat generated by the first speed controller 62 and the second speed controller 64 is accumulated includes the volume of the first pipe 58 and the volume of the second pipe 60. Therefore, the temperature rise of the air is suppressed, and the temperature rise of the air cylinder 42 is suppressed. In addition, since the switching valve 66 is cooled as the air is discharged from the first exhaust port 72 and the second exhaust port 74, the temperature rise of the air cylinder 42 is suppressed.

Although the first aperture and the second aperture are variable apertures in the present embodiment, they may be non-variable apertures. Further, as the first restrictor and the second restrictor, a type in which the air flowing into the air cylinder is reduced while the air discharged from the air cylinder is not reduced (meter-in restrictor) may be adopted. Further, although the switching valve 66 is provided with two exhaust ports, they may be combined into one exhaust port.

Second Embodiment

Figure 7:
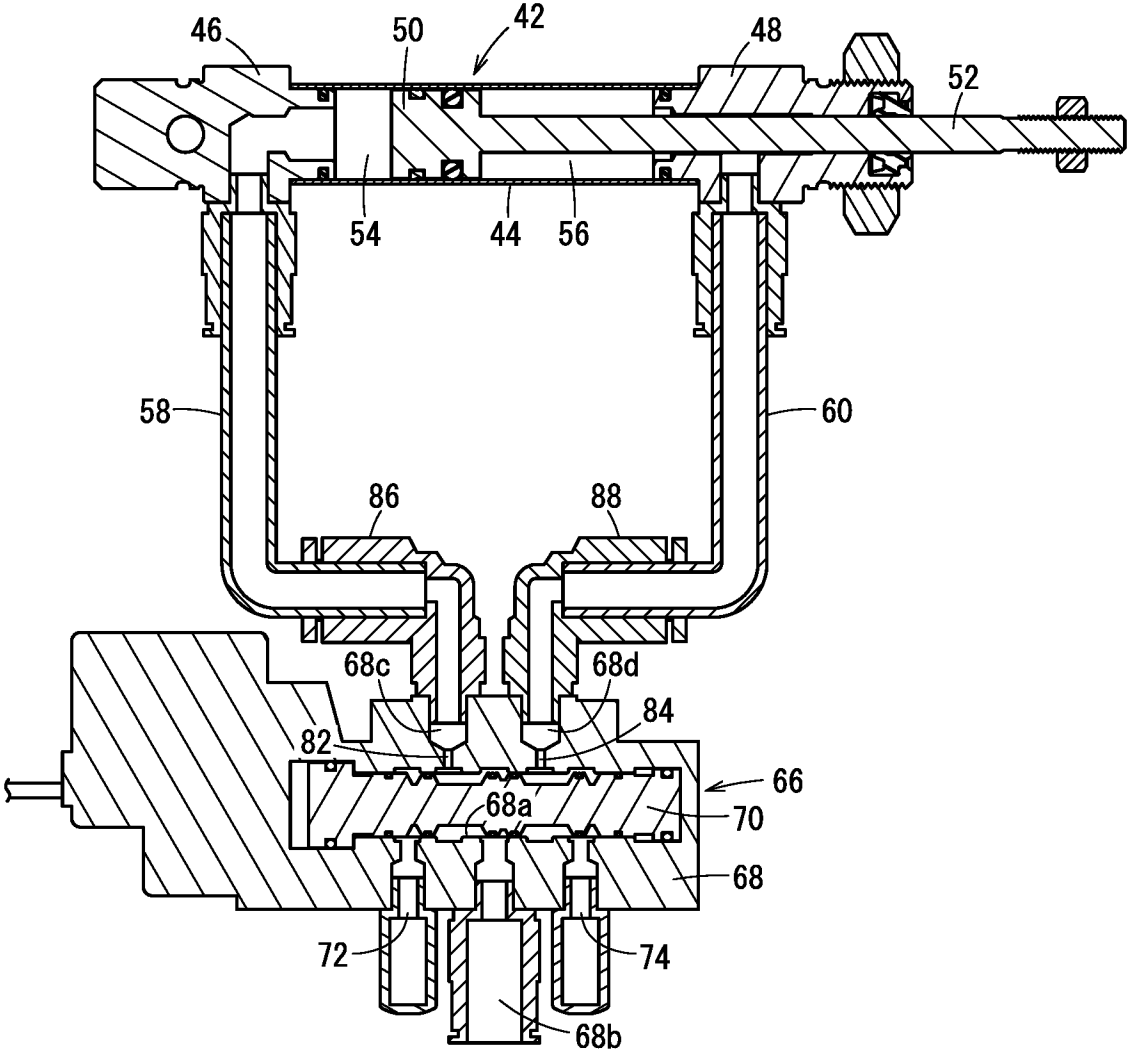
FIG. 7 is a sectional view of a fluid circuit of an air cylinder according to a second embodiment of the present invention.

Next, a fluid circuit 80 of an air cylinder according to a second embodiment of the present invention will be described with reference to FIG. 7. Constituent elements that are the same or equivalent to those of the above-described fluid circuit 40 of the air cylinder are denoted by the same reference numerals, and detailed description thereof is omitted.

The fluid circuit 80 of the air cylinder includes an air cylinder 42, a first pipe 58, a second pipe 60, a first joint 86, a second joint 88, and a switching valve 66. The first joint 86 is an L-shaped joint that connects the first output port 68*c* of the switching valve 66 to the first pipe 58. The second joint 88 is an L-shaped joint that connects the second output port 68*d* of the switching valve 66 to the second pipe 60.

The first restrictor 82 and the second restrictor 84, which are fixed (non-adjustable) restrictors, are built in the switching valve 66. Specifically, the first restrictor 82 is disposed, in the vicinity of the first output port 68*c* of the switching valve 66, between a predetermined portion of the valve hole 68*a* of the body 68 and the first output port 68*c*. The second restrictor 84 is disposed, in the vicinity of the second output port 68*d* of the switching valve 66, between a predetermined portion of the valve hole 68*a* of the body 68 and the second output port 68*d*.

According to the present embodiment, the volume of air in which heat generated by the first restrictor 82 and the second restrictor 84 is accumulated includes the volume of the first pipe 58 and the volume of the second pipe 60. Therefore, the temperature rise of the air is suppressed, and the temperature rise of the air cylinder 42 is suppressed. In addition, since the switching valve 66 incorporating the first restrictor 82 and the second restrictor 84 is cooled as the air is discharged from the first exhaust port 72 and the second exhaust port 74, the temperature rise of the air cylinder 42 is suppressed.

In the present invention, in the flow path from the air cylinder to the switching valve, the portion having the smallest flow path area and the highest throttling effect is defined as the first restrictor and the second restrictor. The present invention may also include a case where another restrictor having a larger flow path area than the first restrictor and the second restrictor is provided in the flow path from the air cylinder to the switching valve.

The present invention is not limited to the embodiment described above, and various configurations may be adopted therein without deviating from the essence and gist of the invention as set forth in the appended claims.

What is claimed is:

1. A fluid circuit for an air cylinder, connected to a switching valve switchable between a first position and a second position, wherein:

the switching valve is provided with exhaust ports, the air cylinder includes a head-side pressure chamber and a rod-side pressure chamber defined by a piston, the head-side pressure chamber is connected by a first pipe to a first output port of the switching valve, the rod-side pressure chamber is connected by a second pipe to a second output port of the switching valve, the switching valve switches between supply and discharge of air to and from the head-side pressure chamber and the rod-side pressure chamber, a first restrictor capable of functioning as a restrictor when the switching valve is switched to the first position and to the second position is arranged adjacent a connection point between the first pipe and the first output port of the switching valve, and a second restrictor capable of functioning as a restrictor when the switching valve is switched to the first position and to the second position is arranged adjacent a connection point between the second pipe and the second output port of the switching valve.

2. The fluid circuit for the air cylinder according to claim 1, wherein:

the first restrictor and the second restrictor are variable restrictors.

3. The fluid circuit for the air cylinder according to claim 1, wherein:

the first restrictor and the second restrictor are fixed restrictors.

4. The fluid circuit for the air cylinder according to claim 1, wherein:

the first restrictor and the second restrictor are meter-in restrictors.

* * * * *